US008726852B2

(12) United States Patent
Gurin et al.

(10) Patent No.: US 8,726,852 B2
(45) Date of Patent: May 20, 2014

(54) FUEL ACTIVATION METHOD AND FUEL SUPPLY SYSTEM

(75) Inventors: Victor Gurin, Hilton, NY (US); Mark Goldsman, Rochester, NY (US); Serguei Permiakov, Kanata (CA); Pavel Pikul, Rochester, NY (US)

(73) Assignee: Helpful Technologies, Inc., Fort Lauderdale, FL (US)

( * ) Notice: Subject to any disclaimer, the term of this patent is extended or adjusted under 35 U.S.C. 154(b) by 0 days.

(21) Appl. No.: 13/541,100

(22) Filed: Jul. 3, 2012

(65) Prior Publication Data

US 2013/0008400 A1 Jan. 10, 2013

Related U.S. Application Data

(60) Provisional application No. 61/504,409, filed on Jul. 5, 2011.

(51) Int. Cl.
*F02M 21/00* (2006.01)
*F02M 25/00* (2006.01)

(52) U.S. Cl.
USPC ..... 123/1 A; 123/525; 123/527

(58) Field of Classification Search
USPC ..... 123/1 A, 2, 3, 27 GE, 525, 527, 531, 123/540, 575; 210/150, 151
See application file for complete search history.

(56) References Cited

U.S. PATENT DOCUMENTS

| | | | | |
|---|---|---|---|---|
| 4,121,542 | A * | 10/1978 | Frie et al. | 123/3 |
| 4,161,164 | A * | 7/1979 | Muhlberg | 123/551 |
| 4,376,423 | A * | 3/1983 | Knapstein | 123/1 A |
| 6,273,072 | B1 * | 8/2001 | Knapstein et al. | 123/527 |
| 6,318,306 | B1 * | 11/2001 | Komatsu | 123/3 |
| 7,011,048 | B2 * | 3/2006 | Gurin et al. | 123/1 A |
| 7,406,955 | B1 | 8/2008 | Gachik | |
| 7,434,568 | B1 * | 10/2008 | Gachik et al. | 123/527 |
| 7,523,747 | B2 | 4/2009 | Gachik | |
| 8,037,849 | B1 * | 10/2011 | Staroselsky et al. | 123/1 A |
| 8,464,694 | B2 * | 6/2013 | Gurin et al. | 123/525 |

* cited by examiner

*Primary Examiner* — Noah Kamen
*Assistant Examiner* — Grant Moubry
(74) *Attorney, Agent, or Firm* — Hershkovitz & Associates, PLLC; Abraham Hershkovitz; Eugene Rzuiedlo

(57) ABSTRACT

A process in which liquid fuel is saturated with a gas to provide a fuel/gas solution said fuel/gas solution fed to a combustion engine, a first portion of said fuel/gas solution that is fed to said combustion engine is combusted, a second portion of said fuel/gas solution that is fed to said combustion engine is not combusted, the temperature of said second portion of said fuel/gas solution is reduced in a heat exchanger to produce a reduced temperature second portion, evaporated gas in said reduced temperature second portion is then removed in a separator, and the fuel/gas solution thus produced is then fed back into the combustion engine.

8 Claims, 3 Drawing Sheets

FUEL ACTIVATION METHOD AND FUEL SUPPLY SYSTEM

CROSS-REFERENCE TO RELATED APPLICATIONS

This application claims the benefits of U.S. Provisional Patent Application No. 61/504,409, filed on Jul. 5, 2011.

FIELD OF THE INVENTION

A method for activating fuel in which a fuel is contacted with gas in an absorber comprised of a multiplicity of gas permeable tubes.

BACKGROUND OF THE INVENTION

Several prior art patents describe methods for "activating fuel" in which a solution of gas and fuel is prepared, and such material is then combusted. Reference may be had, e.g., to U.S. Pat. No. 6,273,072 of Knapstein, U.S. Pat. No. 7,523,747 of Gachik et al.; U.S. Pat. No. 8,037,849 of Staroselsky, and the like. The entire disclosure of each of these United States patents is hereby incorporated by reference into this specification. However, the prior art methods are not very efficient. It is an object of this invention to provide a more efficient method for activating fuel and using it in a diesel engine.

SUMMARY OF THE INVENTION

In accordance with this invention, there provided a method in which liquid fuel is saturated with a gas to provide a fuel/gas composition, said fuel/gas composition is fed to a combustion engine, a first portion of said fuel/gas composition that is fed to said combustion engine is combusted, a second portion of said fuel/gas composition that is fed to said combustion engine is not combusted, the temperature of said second portion of said fuel/gas composition is reduced in a heat exchanger to produce a reduced temperature second portion, evaporated gas in said reduced temperature second portion is then removed in a separator, and the composition thus produced is then fed back into the combustion engine.

DETAILED DESCRIPTION OF THE INVENTION

Figure 1:
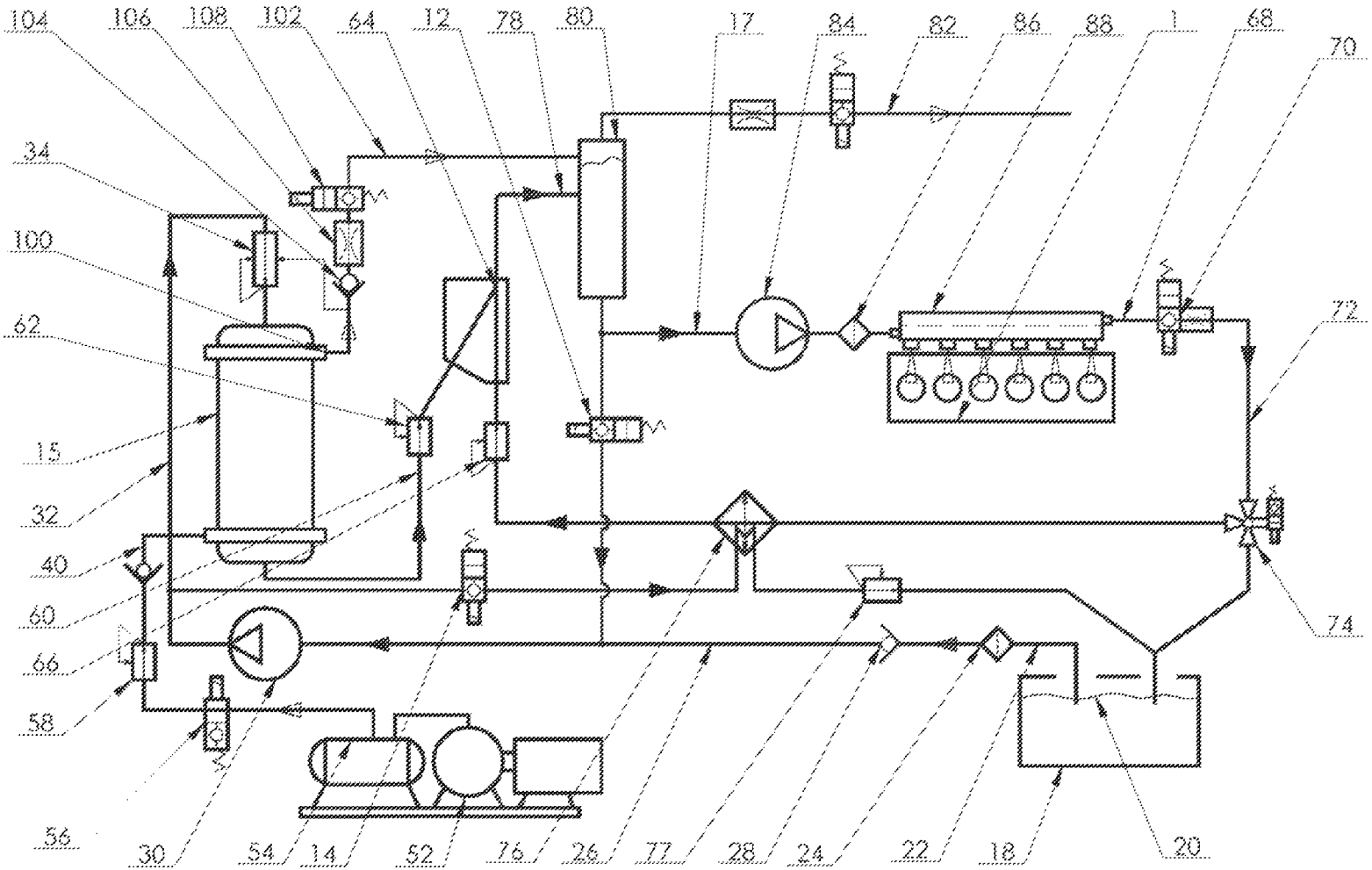
FIG. 1 is a schematic of one preferred process of the invention.

FIG. 1 is a schematic diagram of a fuel supply system 10 comprised of a counter-flow absorber 12.

Referring to FIG. 1, a common rail 88 off diesel engine 1 is connected to a single fuel supply line through an absorber 15. Thus, in this embodiment, in all operational modes the fuel is supplied to the engine through the absorber 15.

Referring again to FIG. 1, a fuel tank 18 is comprised of a fuel 20 that, in one embodiment, preferably, is diesel fuel. In another embodiment, not shown, the fuel is gasoline.

The diesel fuel from tank 18 is then fed via line 22 to filter 24 to remove impurities. The filtered fuel is then fed through line 26 to check valve 28 and then to fuel pump 30. The fuel then pumped through line 32 to differential pressure regulator 34.

In one embodiment, the pressure of the fuel that passes through regulator 34 is preferably from about 20 to 200 pounds per square inch.

Figure 2:
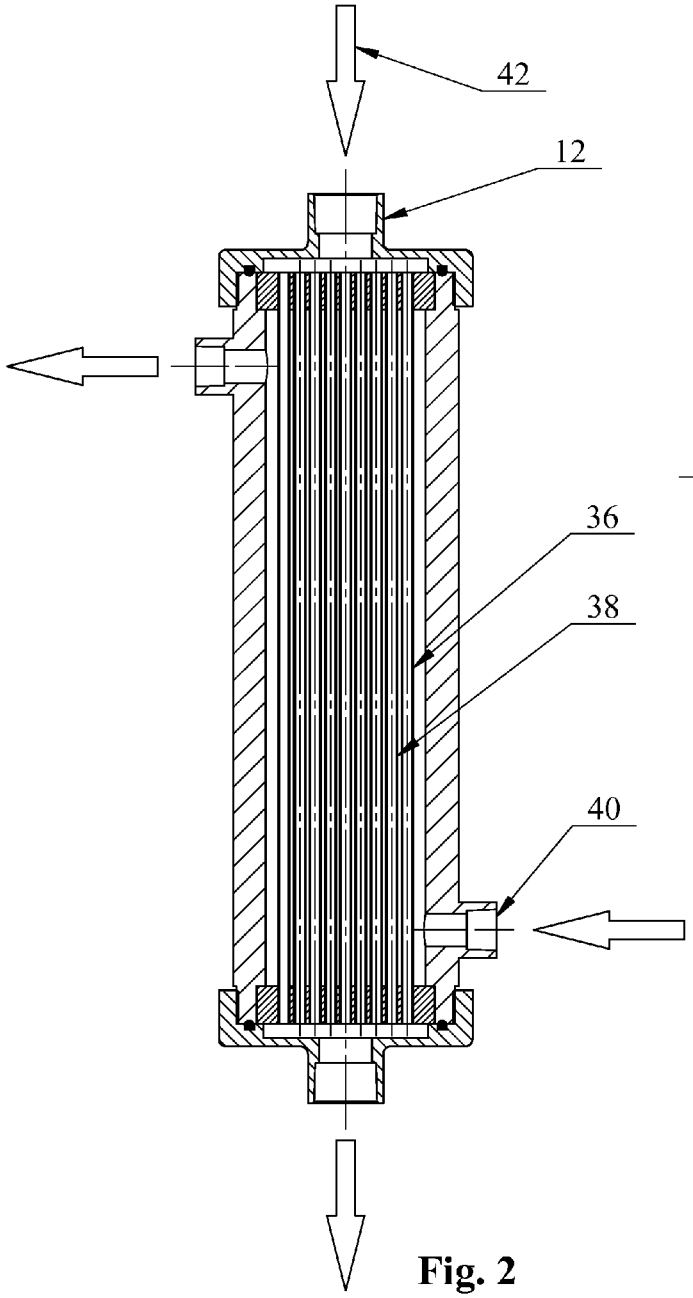
FIG. 2 is a sectional view of one preferred absorber that used in the process of the invention.

The reduced pressure fuel is then fed into absorber 15. FIG. 2 is a sectional view of one embodiment of absorber 15.

Figure 3:
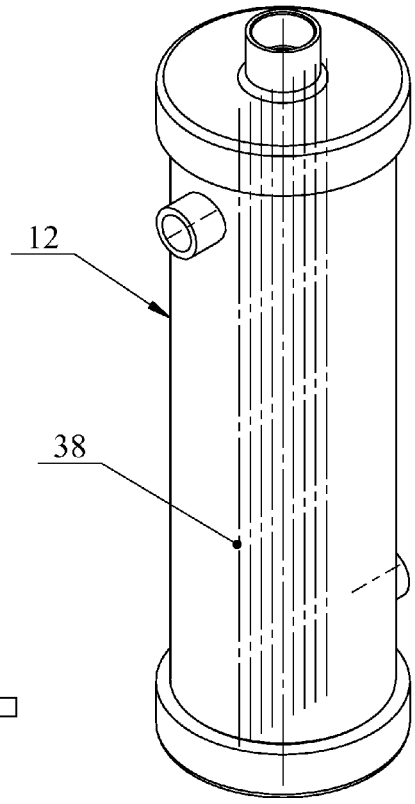
FIG. 3 is a perspective view of the absorber of FIG. 2.

Referring to FIG. 2, such FIG. 3 shows a cross-section view of one embodiment of a counter-flow absorber providing a gas absorption by fuel flow in film mode. The absorber 15 is preferably cartridge type absorber. The cartridge 36 preferably comprises a plurality of tubes 38.

In one embodiment, the tubes 38 have outside diameters of from about 100 to about 1,000 microns and, preferably, inside diameters from about 400 to about 600 microns. The tubes 38 are preferably comprised of a gas permeable material such as, e.g., a gas permeable membrane. Thus, e.g., one may use the same type of material as is used in kidney dialysis cartridges.

Referring again to FIG. 2, the fuel is fed into the absorber 15 and flows inside the tubes 38. In the embodiment depicted in FIG. 2, the gas is fed via line 40 and flows outside the tubes 38. The gas permeates through the walls of the tubes 38 and forms a solution within such fuel.

In the preferred embodiment depicted, there is "counter-flow", that is, the fuel downwardly in the direction of arrow 42, while the gas flows upwardly.

Referring again to FIG. 1, gas is fed to compressor 52. In one embodiment, such gas is air. In another embodiment, the gas is carbon dioxide. In another embodiment, the gas may be argon. It is preferred, in one embodiment, to use air.

The air fed through compressor 52 is then compressed to a pressure that is higher than the pressure of the fuel. In one embodiment, the pressure of the compressed air is from about 1 to about 10 pounds per square inch higher than the pressure of the fuel and, more preferably, from about 1 to about 5 pounds per square inch higher than the pressure of the fuel.

Referring again to FIG. 1, the compressed air is fed into a receiver 54 which, preferably, is part of the compressor assembly. The compressed air is connected to a solenoid valve 56 that is operatively connected to a controller (not shown). Compressed air from the solenoid valve 56 to gas pressure regulating valve 58 which insures that the compressed air is at a proper pressure vis-à-vis the pressure of the fuel. A controller (not shown) is connected to sensors (not shown) and such valves, and it maintains the desired pressure differential within the absorber 15.

Referring again to FIG. 2, and as a result of this method, the gas penetrates through the membrane tubes 38 and is absorbed by fuel forming a "fuel/gas" solution. The "fuel/gas" solution exits through the outlet port 60, preferably at ambient temperature, and it preferably is at substantially the same temperature as is the fuel 20 within tank 18.

In one embodiment, the fuel/gas solution that exits through outlet port 60 is at a pressure of at least 20 pounds per square inch, but preferably about 90 pounds per square inch.

The fuel/gas solution is then fed through a pressure regulator 62, which, in one embodiment, reduces the pressure from about 15 to about 30 percent. Thereafter, the reduced pressure material fuel/gas solution is fed to a Y connector 64 where it is mixed with a feed from regulator 66.

The regulator 66 is feeding excess fuel in return line from engine 1. Such fuel is fed via line 68 and passes through valve assembly 70 and then through line 72 to the three way ball valve 74. The excess fuel is then passed through a heat exchange 76 in which its temperature is reduced to substantially ambient temperature, and the reduced temperature fuel/ gas solution then passed through regulator 66 and mixed at Y connector 64. The regulator 66 keep the back pressure in return line 72.

In one embodiment, the pressure of the feeds into Y connector 64 is substantially equal. The combined feed is then fed via line 78 to a gas/vapor separator 80. Excess gas with fuel vapor is then fed via line 82 to the intake of the engine.

The purified fuel feed from separator 80 is then fed via line 17 to a high pressure secondary pump 84, and the fuel/gas solution free from gas bobbles is pumped through a filter 86 to the inlet port of the common rail 88 of the engine.

Figure 4:
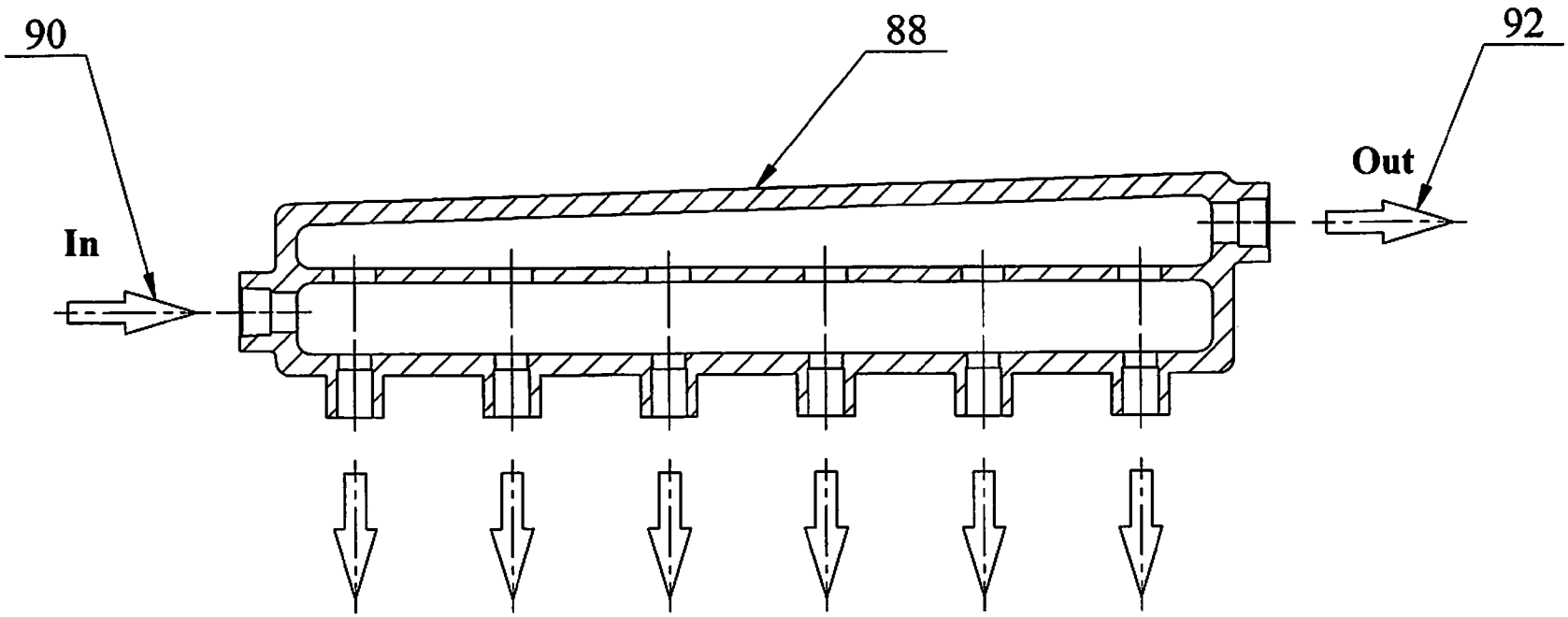
FIG. 4 is a partial sectional view of the common rail of a diesel engine.

FIG. 4 is a schematic view of common rail 88, illustrating the fuel/gas solution being fed in the direction of arrow 90, and excess fuel is withdrawn in the direction of arrow 92 and recycled via line 72 (see FIG. 1).

Referring again to FIG. 1, and in the preferred embodiment depicted therein, an exit port 100 feeds gas into line 102 and then through check valve 104, venture valve 106 and solenoid valve 108 to separator 80. In one embodiment, the fuel supply system of this invention comprises:

- a countercurrent-flow absorber;
- a Y-connector with a downstream pressure reducing regulator to mix a fresh "fuel/gas" solution with the return fuel flow;
- a gas separator;
- a high pressure fuel pump to raise the pressure of the "fuel/gas" solution to operational pressure inside the common rail;
- a return fuel line for the excess fuel exiting the common rail;
- a three-way valve to direct return fuel flow either to the engine through a heat exchanger and upstream pressure regulator or to the fuel tank.

A low pressure pump pumps the fuel from the fuel tank to the absorber. A part of the fuel drawn from the fuel tank flows through the heat exchanger to cool down the return fuel flow. A differential pressure regulator sets the fuel pressure in the absorber lower than the gas pressure at the outlet of the absorber. In the absorber the fuel picks up the gas penetrating through the gas permeable walls of the tubes. The fuel enters the absorber in upper zone and gas enters in lower zone. As the fuel and gas flow in the absorber in opposite directions the gas dissolves in the fuel in pseudo-fluidized liquid/gas mode. The formed "fuel/gas" solution exits the absorber through the bottom port and flows to the Y-connector. A downstream pressure regulator sets the pressure of the "fuel/gas" solution in line with the pressure of the return fuel flow. Any free gas bubbles existing in the mixed fuel solution are separated in the gas-vapor separator. The high pressure fuel pump pressurizes the fuel/gas solution to the operational pressure in the common rail. Excess fuel solution exiting the common rail is directed by the three-way ball valve to the heat exchanger and then to the Y-connector through the back pressure regulator. The gas (air, $CO_2$, or HC gas) is supplied to the absorber by a compressor, and the pressure of the gas is set by a pressure regulator. When the engine operates on the "base" fuel, e.g., at idling, start or shut down then the gas chamber of the absorber is filled with fuel by closing solenoid valve 56 and opening for a short period of time (about 3 to 40 sec) of solenoid valve 108.

Similar result (saturated "fuel/gas" solution) can be achieved by many other methods, and the membrane cartridge type absorber allows simplifying the design and reduces dimensions of the whole fuel system.

FIG. 4 shows a two-stage common rail according to the invention which allows exclude the possibility to supply fuel with free gas bubble to injectors. The fuel solution enters common rail through an inlet port. The bottom stage has several outlet ports connected with injectors. The excess fuel exits the common rail through an outlet port at upper stage. Both stages are connected by several passages to remove free gas bubbles that may appear in fuel solution under uncontrollable circumstances from bottom stage that supply fuel to injectors.

As will be seen from the aforementioned description, and in one preferred embodiment, the pressure is regulated by a differential pressure regulator; the activated liquid fuel/gas solution after the absorber is fed to a Y-connector where it is mixed with the returned fuel, a free gas/fuel vapors are separated from the mixed fuel flow; the separated gas/fuel vapors are directed to the engine air supply line; the liquid fuel flow is fed to the high pressure fuel pump and further to the engine injectors.

In one embodiment, at engine operations other than idling the gas section of the absorber is filled with the gas/gases; and during idling periods the gas section of the absorber is preferably filled with the fuel.

In one embodiment, the system contains, in addition to components of the standard fuel system such as a fuel tank, fuel filters, fuel pumps, etc., the following:

- an absorber for dissolving gas/gases in the liquid fuel, the absorber provides the high contact interface of the liquid fuel and gas/gases using, e.g. gas diffusion membrane tubes;
- a double-deck common rail which design excludes an appearance of the free gas phase at the bottom stage of the common rail feeding the liquid fuel solution to injectors; the fuel solution is supplying to the common rail through the bottom stage and the excess fuel is returned from the upper stage of the common rail; both stages are connected with each other to provide an escape to the free gas bubbles forming e.g. at engine stall or shutdown;
- an absorber fuel supply subsystem, including a differential pressure regulator and a solenoid valve in the supply line;
- a subsystem for removing free gas/fuel vapors from the fuel supply line into the air supply line;
- a subsystem for mixing the fuel solution after the absorber with the returned fuel.

What is claimed is:

1. A fuel activation method, comprising (a) saturating liquid fuel with a gas in a cartridge-type absorber to provide a liquid fuel/gas composition;

(b) feeding said liquid fuel/gas composition to an internal combustion engine;

(c) combusting a first portion of said fuel/gas composition;

(d) feeding a second portion of said liquid fuel/gas composition that is not combusted to a heat exchanger;

(e) producing a reduced temperature second portion liquid fuel/gas composition by reducing the temperature of said second portion;

(f) mixing said reduced temperature second portion liquid fuel/gas composition with said liquid fuel/gas composition;

(g) removing evaporated gas in said reduced temperature second portion liquid fuel/gas composition and said liquid fuel/gas composition mixture in a liquid fuel/gas separator;

(h) forming a composition in which evaporated gas/fuel vapors has been separated from liquid fuel/gas mixture by the liquid fuel/gas separator; and (i) feeding the composition produced in (h) back into the internal combustion engine.

2. The fuel activation method according to claim 1, comprising producing said liquid fuel/gas composition in the cartridge-type absorber having a plurality of permeable tubes.

3. The fuel activation method according to claim 1, further comprising contacting the liquid fuel with gas or a mixture of gases chosen from air, $CO_2$, exhaust gases, and gases containing HC.

4. The fuel activation method according to claim 2, wherein at engine operations other than idling filling the gas section of the absorber with the gas/gases.

5. A fuel supply system which comprises:

a. a cartridge-type absorber for dissolving gas/gases in a liquid fuel, the absorber provides a high contact interface of the liquid fuel and gas/gases to form a liquid fuel solution;

b. a double-deck common rail which excludes an appearance of the free gas phase at the bottom deck of the common rail feeding the liquid fuel solution to injectors; the liquid fuel solution being supplied to the common rail through the bottom stage and excess liquid fuel solution exits at the upper deck of the common rail; both decks being connected with each other to provide an escape to free gas bubbles;

c. an absorber fuel supply subsystem, including a differential pressure regulator and a solenoid valve in the connection line;

d. a subsystem for removing free gas/fuel vapors from the fuel supply line into the air supply line; and e. a subsystem positioned downstream of the absorber for mixing the liquid fuel and gas/gases solution with the returned liquid fuel solution.

6. The fuel activation method according to claim 2, comprising filling a gas section of the absorber with the fuel at engine operations during idling periods.

7. The fuel supply system according to claim 5, wherein the absorber provides the high contact interface using gas permeable membrane tubes.

8. The fuel supply system of claim 5, wherein the mix of fresh liquid fuel solution and excess liquid fuel solution is fed to a liquid fuel/gas separator to form a composition in which free gas/gases has been separated from the liquid fuel solution.

* * * * *